US006418951B1

(12) United States Patent
Douglass

(10) Patent No.: US 6,418,951 B1
(45) Date of Patent: Jul. 16, 2002

(54) HAND GRIP AND BALL GLIDE FOR A WALKER

(76) Inventor: Karl J. Douglass, 3730 Dogwood La., Doylestown, PA (US) 18901

( * ) Notice: Subject to any disclaimer, the term of this patent is extended or adjusted under 35 U.S.C. 154(b) by 0 days.

(21) Appl. No.: 09/442,547

(22) Filed: Nov. 18, 1999

Related U.S. Application Data

(60) Provisional application No. 60/108,838, filed on Nov. 18, 1999.

(51) Int. Cl.[7] ..... A61H 3/00

(52) U.S. Cl. ..... 135/67; 135/71; 280/87.021; 482/68

(58) Field of Search ..... 135/65, 66, 67, 135/71, 72, 73; 74/551.1, 551.9; 297/5, 6; 280/87.021, 87.01, 87.051; 482/66, 68; 16/110 R, 111 R

(56) References Cited

U.S. PATENT DOCUMENTS

| | | | | | |
|---|---|---|---|---|---|
| 1,730,820 | A | * | 10/1929 | Holden | 74/551.9 X |
| 2,425,245 | A | * | 8/1947 | Johnson | 74/551.9 X |
| 2,618,986 | A | * | 11/1952 | Hungerford | 74/551.9 |
| 2,634,790 | A | | 4/1953 | Elle | |
| 2,708,473 | A | | 5/1955 | Gable et al. | |
| 3,289,685 | A | | 12/1966 | Parker | |
| 4,094,331 | A | | 6/1978 | Rozsa | |
| 4,135,535 | A | | 1/1979 | Thomas | |
| 4,403,787 | A | * | 9/1983 | Shimano | 74/551.9 X |
| 4,411,283 | A | | 10/1983 | Lucarelli | |
| 4,466,309 | A | * | 8/1984 | Matey | 74/551.9 |
| 4,491,257 | A | | 1/1985 | Ingles | |
| 4,777,973 | A | | 10/1988 | Nakajima | |
| 4,907,794 | A | | 3/1990 | Rose | |
| 4,941,496 | A | | 7/1990 | Berning | |
| 5,005,599 | A | | 4/1991 | Cunningham | |
| 5,201,333 | A | | 4/1993 | Shalmon et al. | |
| 5,255,696 | A | | 10/1993 | Leonard | |
| 5,311,880 | A | | 5/1994 | Lancaster et al. | |
| 5,339,853 | A | | 8/1994 | Sokolis et al. | |
| 5,445,174 | A | | 8/1995 | Cunningham | |
| 5,469,343 | A | | 11/1995 | Speck | |
| 5,495,867 | A | | 3/1996 | Block | |
| 5,520,597 | A | | 5/1996 | Tobin | |
| 5,529,425 | A | | 6/1996 | Spies et al. | |
| 5,579,793 | A | | 12/1996 | Gajewski et al. | |
| 5,657,783 | A | | 8/1997 | Sisko et al. | |
| 5,711,334 | A | * | 1/1998 | Roux | 135/65 |
| 5,785,070 | A | * | 7/1998 | Block et al. | 135/67 |
| 6,082,384 | A | * | 7/2000 | Cheng | 135/67 X |

* cited by examiner

*Primary Examiner*—Beth A. Stephan
*Assistant Examiner*—Winnie Yip
(74) *Attorney, Agent, or Firm*—Akin, Gump, Strauss, Hauer & Feld, L.L.P.

(57) ABSTRACT

A hand grip having an elongate member with a length and a cross-sectional profile perpendicular to the length. The cross sectional profile has a first convex surface, a second convex surface adjacent the first convex surface, a third convex surface adjacent the second convex surface, and a fourth surface between the first and third convex surfaces. A retention rib extends outwardly from the fourth surface and extends at least a portion of the length of the elongate member, the retention rib being generally u-shaped in cross section. A walker having a front frame having opposing lateral ends, and first and second side frames connected to the front frame at the lateral ends thereof, respectively. Each side frame has fore and aft generally vertical leg portions, the leg portions each have a lower end, and an end cap positioned on the lower end of each of at least two of the leg portions. The end cap is at least semi-spherically shaped.

3 Claims, 8 Drawing Sheets

HAND GRIP AND BALL GLIDE FOR A WALKER

CROSS REFERENCE TO RELATED APPLICATION

This application claims priority, under 35 U.S.C. §119(e), to U.S. Provisional Application No. 60/108,838 filed on Nov. 18, 1999, entitled Handgrip and Ball Glide for a Walker, which is incorporated herein by reference in its entirety.

BACKGROUND OF THE INVENTION

The present invention relates to an improved design for a handle for an orthopedic walker and for a ball glide for the base of a leg of an orthopedic walker.

Walkers are essential to the mobility of many individuals who suffer from handicaps which affect the lower extremities. Current walker designs, however, are afflicted with shortcomings which limit the amount of use a handicapped individual can make of the walker. Notable among these shortcomings are non-ergonomically-designed handles or hand grips, and walker leg terminal end caps that do not move readily over obstacles.

While numerous attempts have been made to create ergonomic hand grips for walkers, these attempts have been unsuccessful due to failure to recognize the nature of a grip profile capable of conforming most naturally to the shape of a human hand, or the inability to integrate such shapes into walker handles. The result of these failures is primarily the risk of the user falling due to having a less than secure grip on the walker. This risk is significantly magnified due to the hand fatigue created by non-ergonomically-designed hand grips.

The hand grip design of the present invention overcomes the shape-related failures of prior attempts by recognizing that an ergonomic hand grip design must conform to the natural shape of the human hand and the hand is far more adept at grasping a sphere on a uniform cylinder. Thus, the hand grip design of the present invention incorporates curvature in several planes to provide greater comfort and safety for the user.

Due to the design of most walkers, the grip is often incorporated on a spine or handle which generally is closed, i.e., butted on each end by a structural support member. This structural configuration has greatly limited prior designs in terms of hand grip shapes that could be employed, materials that could be used, and interchangeability of hand grips. Prior art hand grips are not easily interchangeable in the field. An additional but no less significant benefit of the hand grip of the present invention is the ability to incorporate the unique ergonomic design of the present invention onto a handle or spine which is in abutting relationship on each end with a structural member. This structure, used on virtually all walkers, has greatly limited the ability of designers to incorporate ergonomic shapes into hand grips. Attempts to create ergonomic hand grips have been unsuccessful because the internal mounting surface on the grip and the external mounting surface on the walker are cylindrical, necessitating the use of adhesive which often fails over time. The present invention overcomes this limitation by providing a hand grip which is both easily removable and, once assembled, is extremely secure.

As mentioned above, walker designs have also been afflicted with shortcomings relating to leg end caps which do not move readily over obstacles. Prior art designs have included traditional cup-shaped rubber feet, small skis, or inverted, small semi-spherical mushroom-shaped caps having a total height of about a quarter of an inch. Each of these prior art designs fails, however, when the user encounters a throw rug or similar obstruction. For example, the traditional cup merely contacts and advances a ridge in the rug, and the ski and inverted mushroom designs slide beneath the rug. The result is that the user must stop his or her forward movement, lift the walker, move the walker rearward, further lift the walker, and advance forward. This presents a significant, frequent and dangerous problem for these handicapped individuals.

The end cap of the present invention overcomes these shortcomings by employing a cap which moves readily over obstacles, such as a throw rug, and does so employing a configuration which is inexpensive to manufacture. The end cap of the present invention has a generally spherical shape which not only glides over the edges of obstacles, but, in the case of a throw rug, rides over whatever roll is pushed ahead of the end cap. In the preferred embodiment, a further advantage is provided wherein the weight of the end cap is reduced by elimination of non-essential material on the external surface of the end cap.

BRIEF SUMMARY OF THE INVENTION

Briefly stated, the present invention is a hand grip which includes an elongate member having a length and a cross-sectional profile perpendicular to the length. The cross sectional profile has a first convex surface, a second convex surface adjacent the first convex surface, a third convex surface adjacent the second convex surface, and a fourth surface between the first and third convex surfaces. A retention rib extends outwardly from the fourth surface and extends at least a portion of the length of the elongate member. The retention rib is generally u-shaped in cross section.

In another aspect the present invention includes a walker having a front frame having opposing lateral ends and first and second side frames connected to the front frame at the lateral ends thereof, respectively. Each side frame has fore and aft generally vertical leg portions and a first handle positioned at an upper region of each side frame. The first handle has a hand grip. The hand grip includes an elongate member having a length and a cross-sectional profile perpendicular to the length. The cross sectional profile has a first convex surface, a second convex surface adjacent to the first convex surface, a third convex surface adjacent to the second convex surface, and a fourth surface adjacent to the first and third convex surfaces. A retention rib extends outwardly from the fourth surface and extends at least a portion of the length of the elongate member. The retention rib is generally u-shaped in cross section.

Another aspect of the present invention is directed to a walker including a front frame having opposing lateral ends and first and second side frames connected to the front frame at the lateral ends thereof, respectively. Each side frame has fore and aft generally vertical leg portions. The leg portions each have a lower end. An end cap is positioned on the lower end of each of at least two of the leg portions. The end cap is at least semi-spherically shaped.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
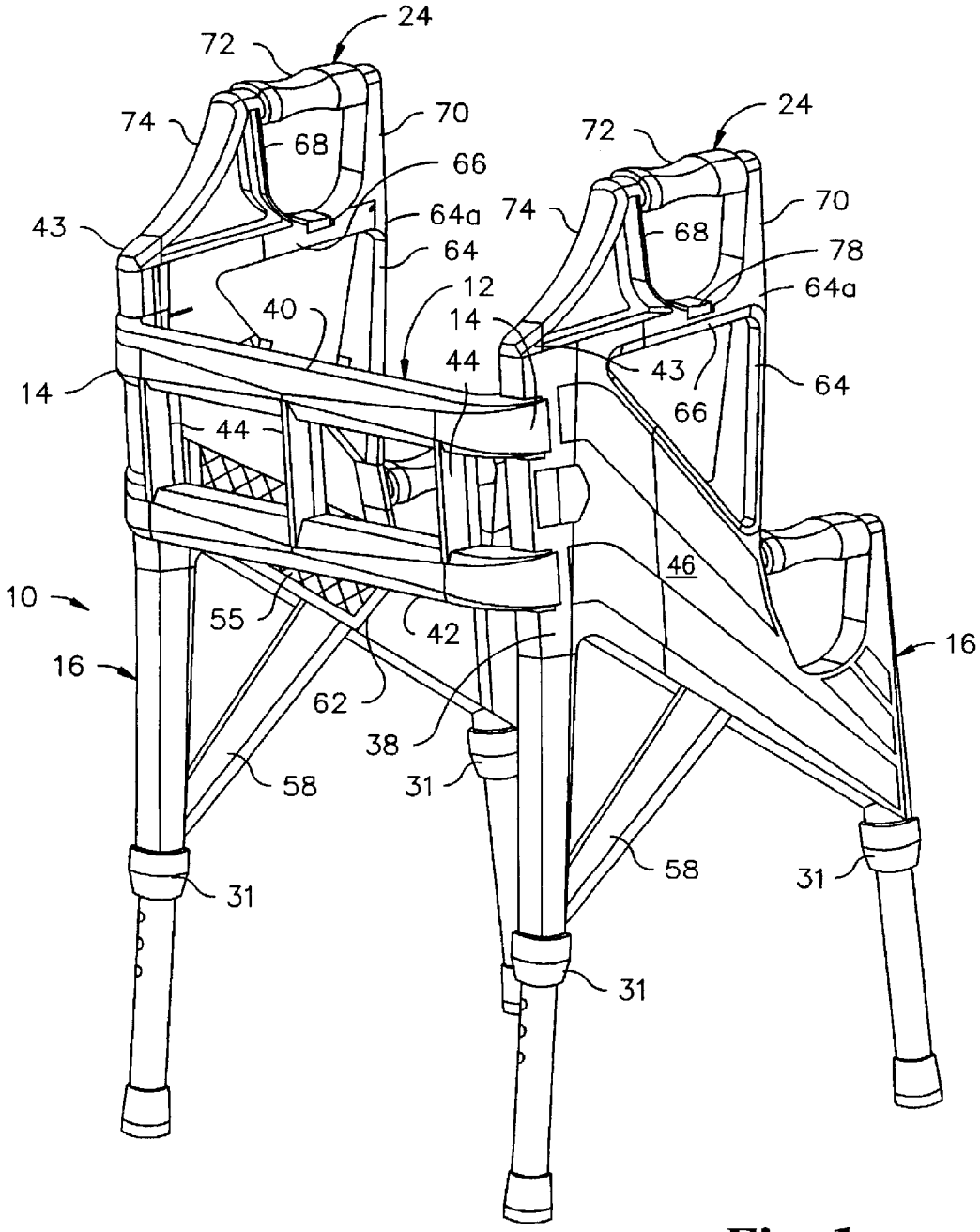
FIG. 1 is a front perspective view of a walker in accordance with a first embodiment of the present invention.

Certain terminology may be used in the following description for convenience only and is not limiting. The words "left", "right", "upper", and "lower" designate directions in the drawings to which reference is made. The words "inwardly" and "outwardly" refer to directions toward and away from, respectively, the geometric center of the walker and designated parts thereof. The terminology includes the words above specifically mentioned, derivatives thereof, and words of similar import.

Figure 2:
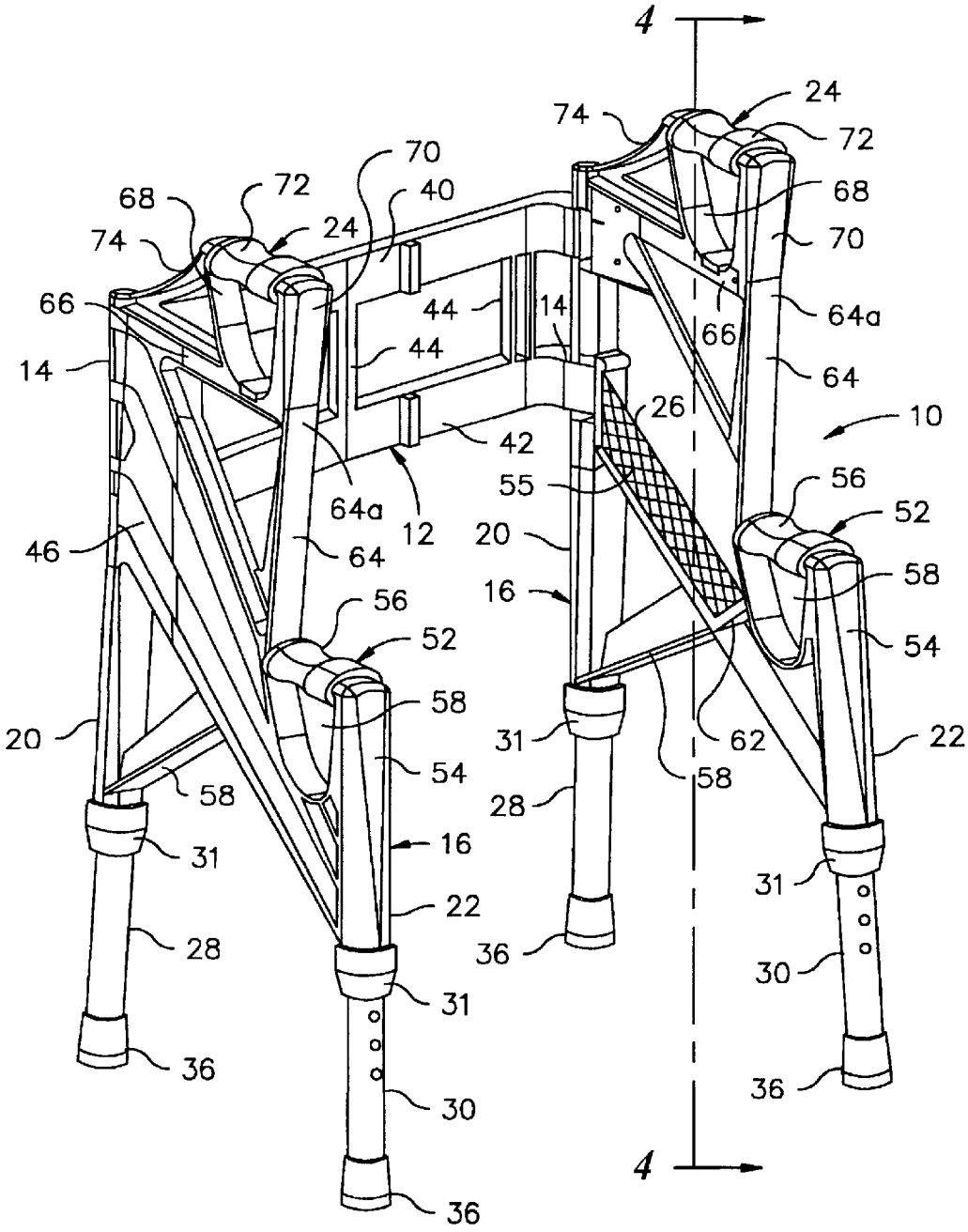
FIG. 2 is a rear perspective view of the walker shown in FIG. 1.
Figure 3:
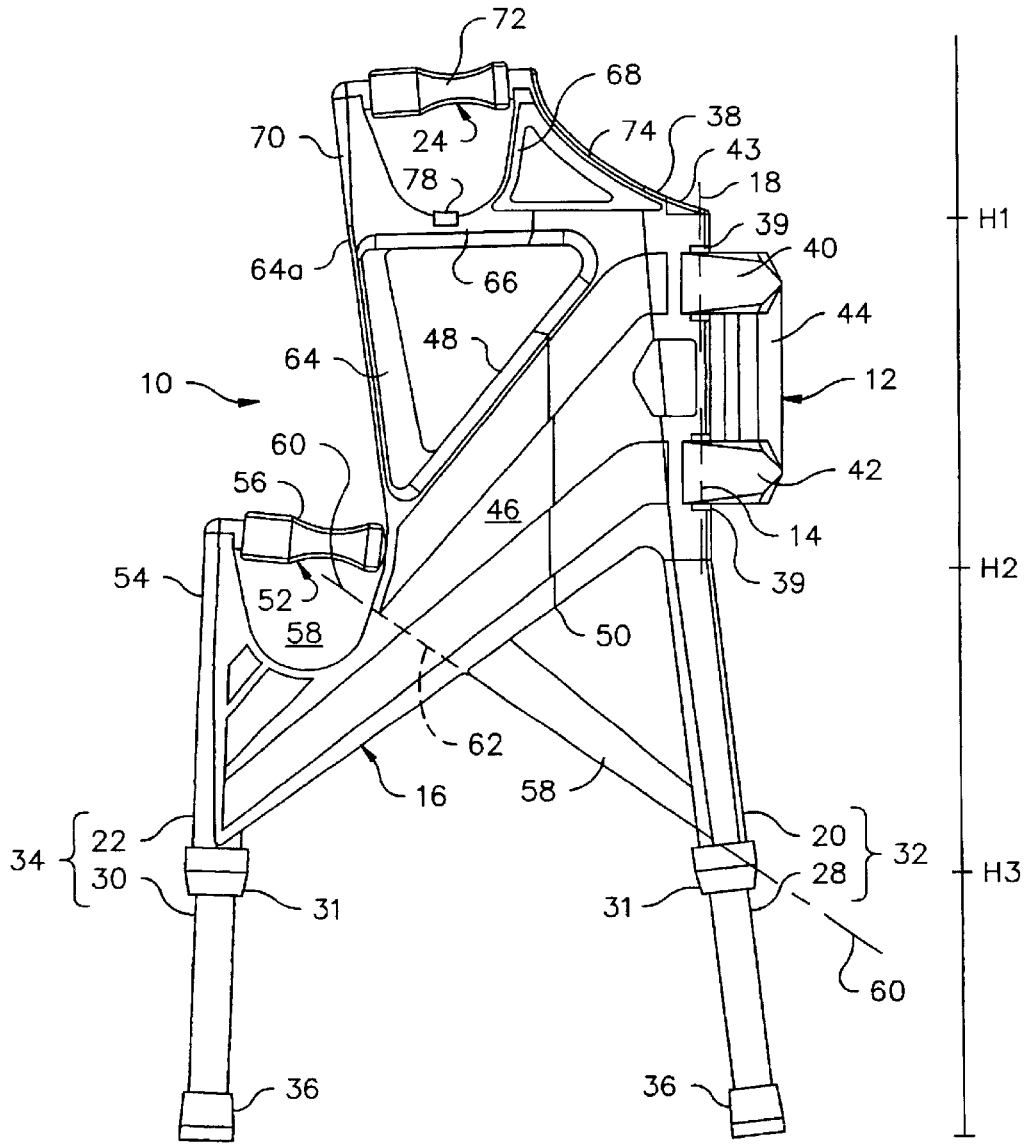
FIG. 3 is a left side elevational view of the walker shown in FIG. 1.

Referring to the drawings in detail, wherein like numerals are used to indicate like elements throughout, there is shown in FIGS. 1–4 a walker, generally designated 10, in accordance with a first embodiment of the present invention. As seen, the walker has a front frame 12 with opposing lateral ends 14, and side frames 16 connected to the front frame 12 at the lateral ends 14, respectively. In the first embodiment each side frame 16 is pivotable with respect to the front frame 12 about a generally vertical pivot axis 18 (shown in FIG. 3) coextensive with the respective lateral end 14, as described in more detail hereinafter. Each side frame 16 has fore and aft generally vertical leg portions 20, 22, respectively. It should be understood that the side frame shown in FIG. 3 is a mirror image of the side frame 16 on the opposite side of the walker 10. A first handle 24 is positioned at an upper region of each side frame 16. It should be understood that the side frame shown in FIG. 3 is a mirror image of the side frame 16 on the opposite side of the walker 10.

While in the first embodiment it is preferred that the side frames 16 are pivotable with respect to the front frame 12, it is understood by those of ordinary skill in the art from this disclosure that the present invention is not limited to pivotally mounting the side frames 16 to the front frame 12. That is, the side frames 16 could be fixed in position with respect to the front frame 12, without departing from the spirit and scope of the invention.

In the first embodiment, each of the front frame 12 and the side frames 16 is formed substantially from a polymer. Although not required, it is also preferred that about 5–20% of the volume of the polymer be filled with glass or carbon fibers or other fillers, to further add to the structural integrity of the walker 10. The present invention is not limited to using any particular polymer or glass fiber. The polymer must have the necessary characteristics such that when it is formed as shown in FIGS. 1–4, the walker 10 can be used for its intended purpose without failure. Examples of polymers which satisfy this criteria include, the polypropylene manufactured by Sundance Products, Inc. of Gainesville, Georgia as product code number SP200-6B; the polypropylene copolymer sold under the trade name Pro-fax SB-823 by the General Polymers division of Ashland Chemical of Atlanta, Ga.; and polypropylene AP 7310 sold by Polycom Huntsman of Washington, Penn.

Preferably, each of the front frame 12 and the side frames 16 is formed from the polymer substantially as a unitary body. Accordingly, each of the front frame 12 and the side frames 16 may be formed substantially as one piece in a single process from a single mold through structural foam injection molding or the like. Of course, one skilled in the art will appreciate from this disclosure that other means of forming the aforementioned frame elements may be employed, such as straight injection molding, blow molding, or thermoforming, without departing from the scope of the present invention. Moreover, one skilled in the art will appreciate that each of the aforementioned frame elements need not be entirely formed as a unitary body. For example, and as seen in FIG. 2, one of the side frames 16 may include netting or mesh 26 or the like to form a small pocket in the side frame 16.

As best seen in FIG. 2, the fore and aft leg portions 20, 22 of each side frame 16 are fore and aft upper leg portions 20, 22 and the walker 10 also has fore and aft generally vertical lower leg portions 28, 30. As such, the fore and aft upper and lower leg portions 20, 22, 28, 30, respectively combine to form fore and aft legs 32, 34, as seen in FIG. 3.

As shown, the fore and aft legs 32, 34 are adjustable by adjusting the fore and aft lower leg portions 28, 30, with respect to the fore and aft upper leg portions 20, 22. Preferably, the fore and aft upper leg portions 20, 22 of each side frame 16 are generally tubular, and the fore and aft lower leg portions 28, 30 telescope down from within the respective upper tubular leg portions 20, 22. Also preferably, appropriate locking threaded collar/pin type devices 31 are provided to secure each leg 32, 34 at the suggested height. The present invention is not limited to any particular locking device and further description of the locking devices is omitted for purposes of brevity and convenience only as such locking devices are well understood by those of ordinary skill in the art.

While it is preferred that the fore and aft legs 32, 34 be height adjustable, one skilled in the art will appreciate from this disclosure that the height of each leg 32, 34 may be fixed without departing from the sprit and scope of the present invention. In fact, it may be desired to produce several different models of the walker 10 with fixed leg heights, rather than to provide the aforementioned adjustable legs. Similarly, the present invention is not limited to constructing the fore and aft legs 32, 34 substantially of a polymer. For instance, the fore and aft lower leg portions 28, 30 could be constructed of aluminum tubing, without departing from the spirit and scope of the invention.

As seen, each aft leg 32, 34 includes an anti-skid end cap 36'. However, one skilled in the art will appreciate that wheels or other devices (not shown) may replace some or all of the end caps 36 without departing from the spirit and scope of the present invention.

Since, in a conventional aluminum walker, the aluminum is a relatively strong material, little need or consideration need be given to stress factors, tensile strength, load bearing weights, and other structural engineering concerns. Simply put, it can usually be assumed that the typical one inch aluminum tubing will provide proper structural support for most typical walker users. Polymers, on the other hand, are not typically relatively strong materials as compared with aluminum, and therefore the aforementioned structural engineering factors become much more of a concern. However, because polymers can be formed into a multitude of shapes, the walker 10 of the present invention has been provided with a geometrical shape which can efficiently withstand the imposed loads, even after being exposed to environmental conditions (e.g., temperature, humidity, ultraviolet degradation, sand/dirt, bacteria, etc.) that can degrade the polymer.

In the walker 10 of the present invention, it has been found that the heaviest stresses occur at the pivot axes 18 or where the side frames 16 meet the front frame 12 at the respective lateral ends 14 thereof when loaded in a forward tilting manner of up to 20 degrees from a line extending perpendicularly from the floor. Accordingly, it is preferable that each side frame 16 has a relatively sturdy pivot portion 38 (as seen in FIGS. 1 and 3) at a fore side corresponding to the fore leg 32, where the pivot or front portion 38 is generally coextensive with the pivot axis 18 and extends from a first vertical height H1 above a main portion of the front frame 12 to a second vertical height H2 below the main portion of the front frame 12, as is shown in FIG. 3. As seen, each upper leg portion 20, 22 extends down from about the second vertical height H2 to a third vertical height H3.

Figure 4:
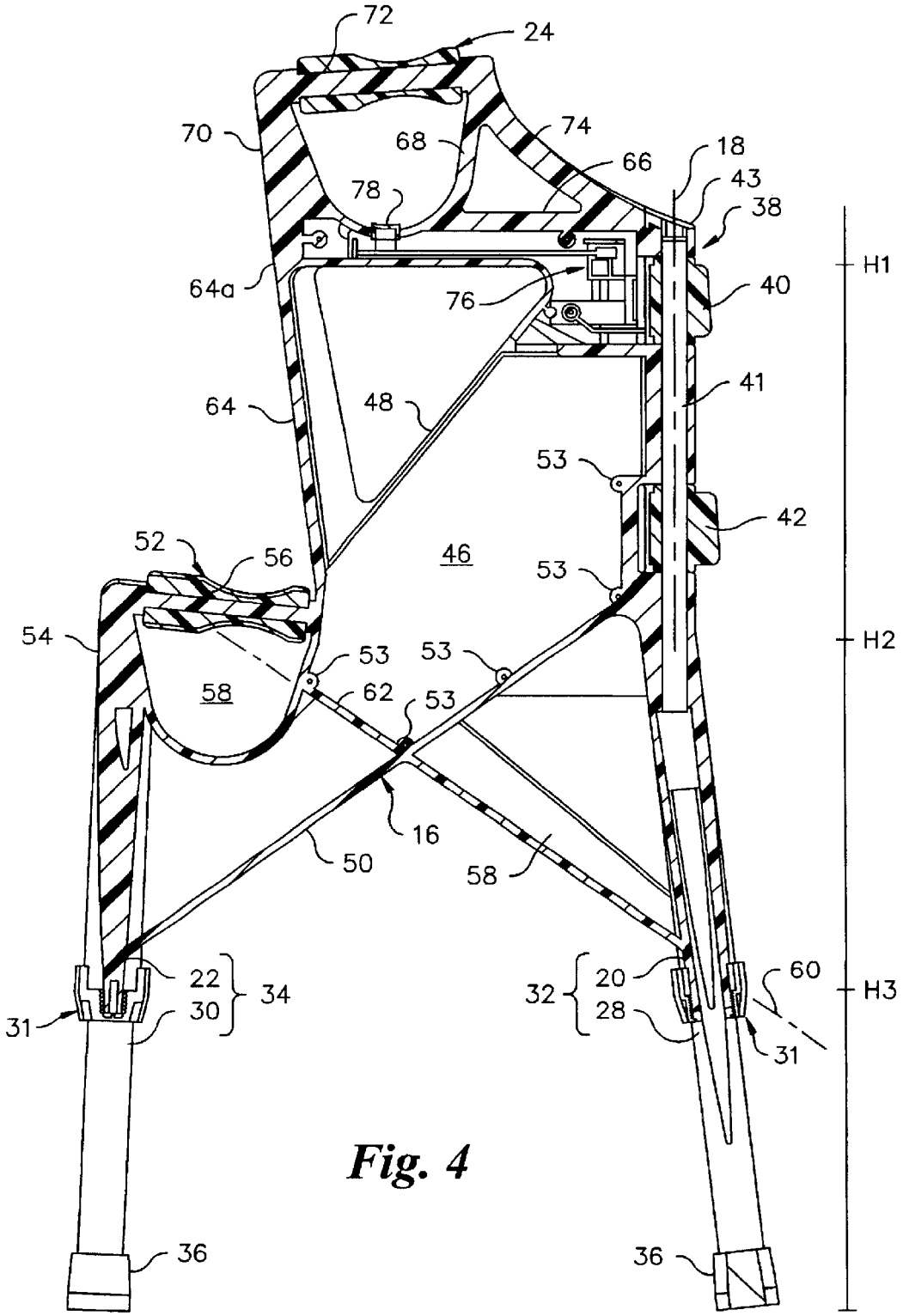
FIG. 4 is an enlarged cross-sectional view of the walker shown in FIG. 2 taken along lines 4—4 of FIG. 2.

Referring now to FIGS. 1, 3 and 4, it is seen that the front frame 12 preferably has upper and lower generally horizontal cross bars 40, 42 spaced a predetermined generally vertical distance apart from one another, where each cross bar 40, 42 extends between the opposing lateral ends 14 of the front frame 12. The cross bars 40, 42 are generally linear in the middle with generally arcuate terminal ends. The terminal ends of the cross bars 40, 42 include generally vertically extending bores which rotatably receive a complementary hollow pintle 41. The pintle 41 also extends through a complementary bore in the pivot portion 38 both between the cross bars 40, 42 and just below the lower cross bar 42. A gap 39 is provided in the pivot portion 38 for receiving the terminal ends of the cross bars 40, 42. The pintle 41 permits the side frames 16 to pivot with respect to the front frame 12.

The present invention is not limited to constructing the pintle 41 of any particular material. The pintle 41 could constructed of the same polymer as that used to construct the balance of the walker 10 or could be constructed of a light weight high strength material, such as aluminum. It is also understood by those of ordinary skill in the art from this disclosure that the pintle 41 could be solid (not shown) as opposed to hollow. The benefit of a hollow pintle 41 is that a removable cap 43 can be releasably positioned at the top of the pivot portion 38 in alignment with the pintle 41. When the cap 43 is removed, various items can be releasably mounted in the pintle 41, such as an umbrella and an I.V. tube support rod (not shown).

In the first embodiment, the front frame 12 has at least one generally vertical pillar 44 interconnecting the upper and lower cross bars 40, 42. As seen in FIG. 1, three pillars 44, are preferably provided, although one skilled in the art will appreciate that other numbers of pillars may be provided without departing from the spirit and scope of the present invention. Preferably, the first vertical height H1 is just above the upper cross bar 40 and the second vertical height H2 is just below the lower cross bar 42.

In using the walker 10, the greatest load occurs when the walker user moves the walker 10 forward and rests the walker 10 on the aft legs 34 while at the same time bearing down on the first handles 24. Accordingly, such load is preferably transferred from the pivot portion 38 down to the aft legs 34 by way of a main support 46 that extends generally diagonally from the pivot portion 38 at the fore side to the upper aft leg portion 22 at the aft side of the side frame 16. As best seen in FIGS. 3 and 4, the main support 46 at the fore side (corresponding to the fore leg 32) extends from about the first vertical height H1 to the second vertical height H2. Accordingly, the main support 46 preferably joins directly to the pivot portion 38 along substantially the entirety of the vertical height of the pivot portion 38. As also seen, the main support 46 at the aft side of the side frame 16 (corresponding to the aft leg 34) extends up from about the third vertical height H3. Generally, the main support 46 has an upper side 48 and a lower side 50 (as shown in FIGS. 3 and 4) which converge toward each other in the direction of the aft legs 34, although it is seen that an aft portion of the upper side 48 is interrupted by a second handle 52 positioned thereatop. The main support 46 is generally U-shaped in cross section with the open end of the "U" facing inwardly toward the other side frame 16. The legs of the U-shaped main support 26 include fastener bosses 53 for receiving standard fasteners 55 (i.e., self tapping screws) to attach the netting 26 to the side frame 16, as shown in FIGS. 1, 2 and 4.

More specifically, it is seen that the second handle 52 includes an upper segment 54 of the upper aft leg portion 22 as an aft post and a generally horizontal grip 56 at about the second vertical height H2 extending between the aft post 54 and the upper side 48 of the main support 46. Accordingly, the second handle 52 defines a gripping aperture 58 which extends into the main support 46.

As should now be understood, when a walker user grasps the grip 56 of the second handle 52 to, for example, rise out of a chair, the load exerted by the walker user onto the grip 56 is transferred through the upper segment 54 of the upper aft leg portion 22 and through the main support 46 to the fore leg 32. Of course, one skilled in the art will appreciate that equivalent structural schemes may be employed for the second handle 52 without departing from the spirit and scope of the present invention.

Referring now to FIGS. 3 and 4, the side frame 16 has a first strut 58 extending generally diagonally from a midpoint on the lower side 50 of the main support 46 to the upper fore leg portion 20 at about the third vertical height H3. The first strut 58 is generally T-shaped in cross section, the bottom portion of which faces the floor (not shown) and extends generally along a first line 60. The main support 46 further has a first rib 62 extending from the lower side 50 to the upper side 48 generally along the first line 60. The first rib 62 and the first strut 58 provide the walker 10 with structural integrity. While it is preferred that the first strut 58 be generally T-shaped in cross section, it is understood by those of ordinary skill in the art that the first strut 58 could have other configurations, such as generally I-shaped in cross section.

Referring now to FIGS. 1, 3 and 4, each side frame 16 further includes a second strut 64 extending generally vertically from a midpoint on the upper side 48 of the main support 46 to an end 64*a* thereof at about the first vertical height H1. The second strut 64 is preferably generally T-shaped in cross section. A third strut 66 extends generally horizontally from the upper side 48 of the main support 46 at about the first vertical height H1 to the end 64*a* of the second strut 64 at about the first vertical height H1. Each side frame 16 further has a fourth strut 74 extending generally arcuately and diagonally from the upper side 48 of the main support 46 at about the first vertical height H1 to the fore post 68 of the first handles 24 adjacent the fore handle end 80 of the first handles 24.

Referring now to FIG. 4, the third strut 66 and the upper corner of the main support 46 include a hollow area which houses a locking mechanism, generally designated 76, for locking the side frames 16 in the open position. A latch release button 78 is provided in the base of the first handles 24 for releasing the locking mechanism 76 to allow the side frames 16 to be pivoted to the closed position (not shown). The locking mechanism 76 does not pertain to the present invention. Further, such locking mechanisms are well known to those of ordinary skill in the art. Accordingly, a detailed description of the locking mechanism 76 is omitted for purposes of brevity and convenience only and is not limiting.

Referring now to FIGS. 5–11, there is shown a walker 10 in accordance with a second embodiment of the present invention. The second embodiment is identical to the first embodiment, except for the first and second hand grips 24', 52', the end caps 36' on the aft vertical leg portions 22 and the wheels 37' on the fore vertical leg portions 20. Accordingly, a complete description of the second embodiment of the walker 10 is not repeated herein. Instead, like elements have been given identical element numerals and only the differences between the first and second embodiments of the plastic walker 10 are described below with prime numerals being used for the new features of like elements.

Figure 5:
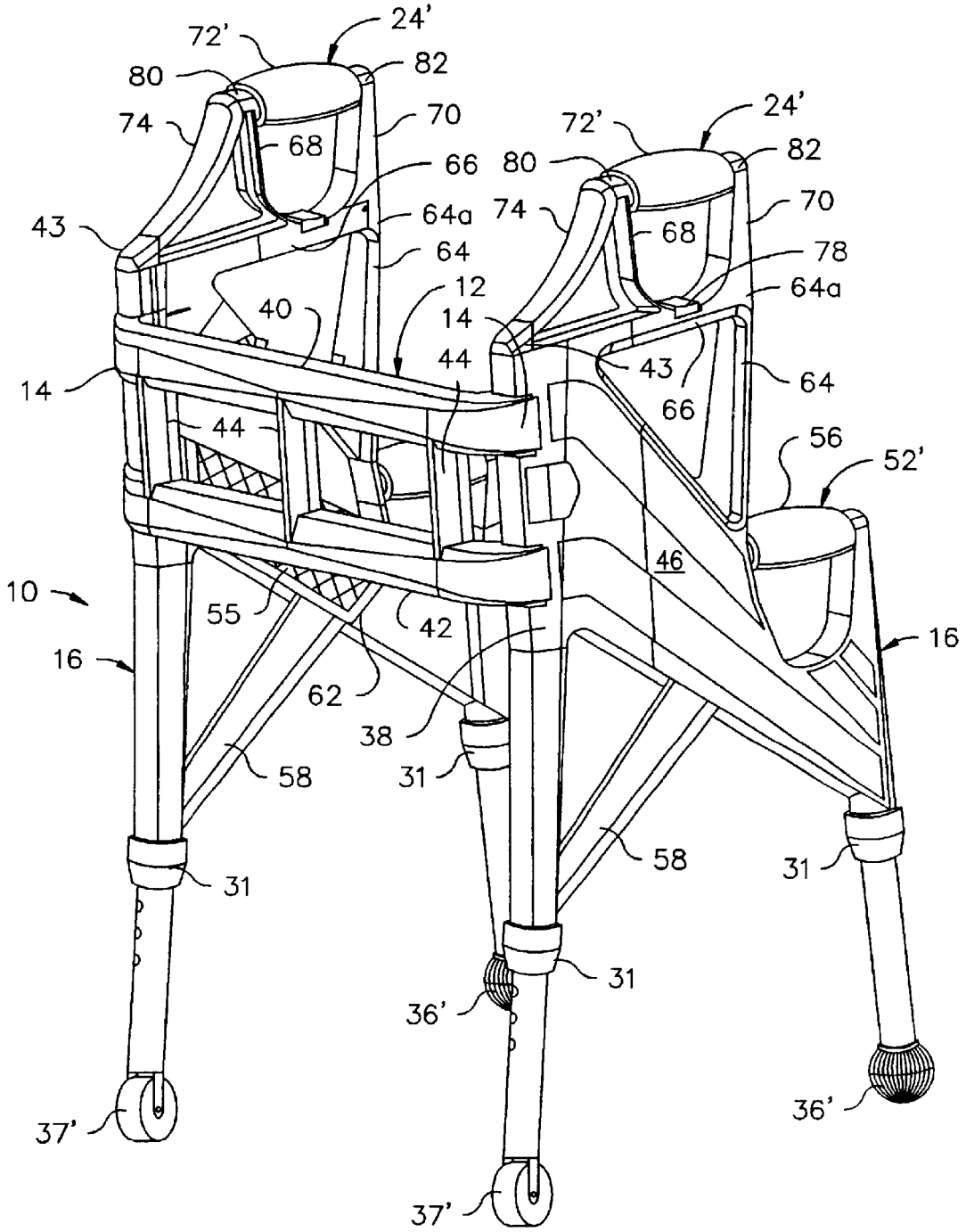
FIG. 5 is a front perspective view of a walker in accordance with a second embodiment of the present invention.
Figure 6:
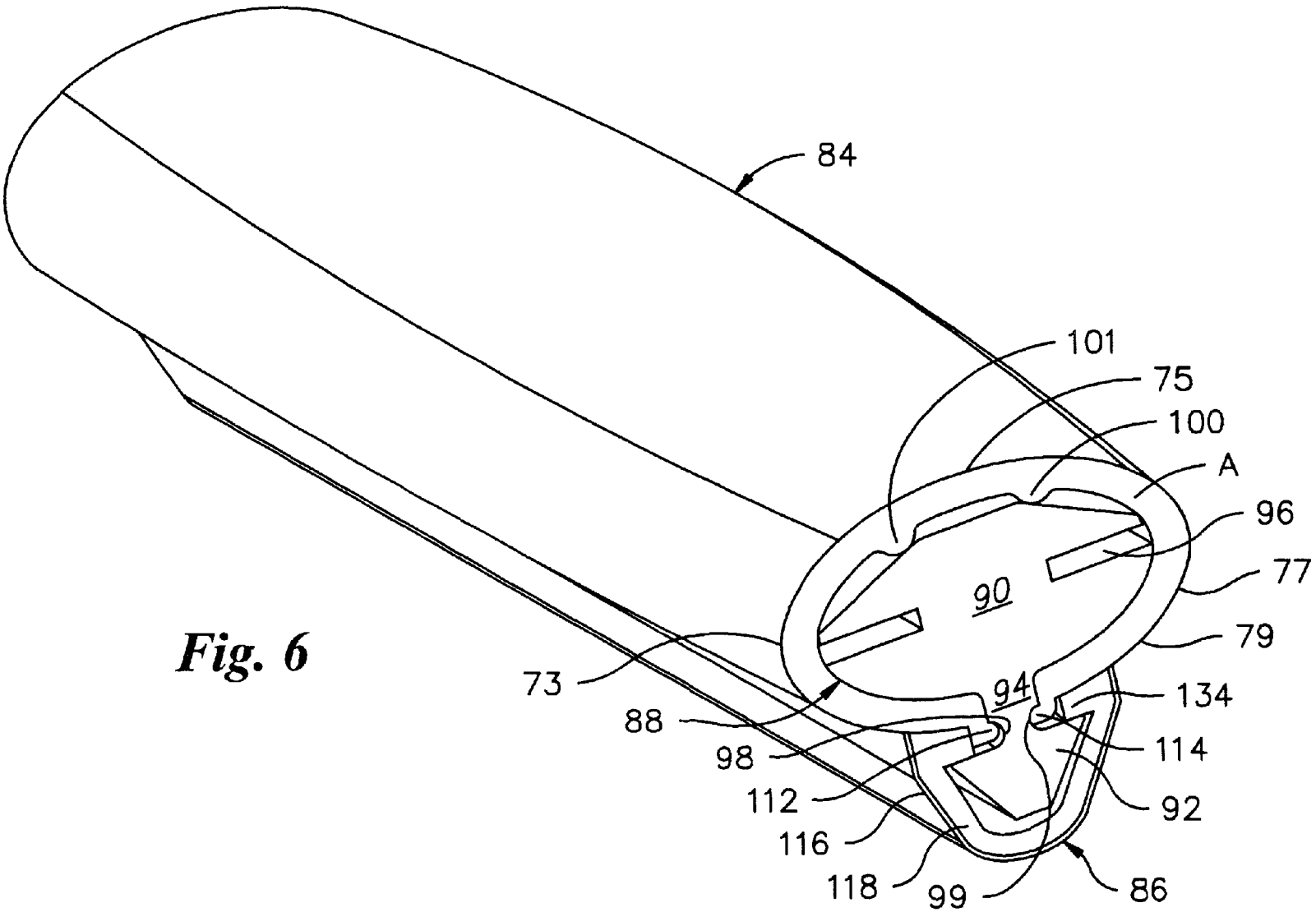
FIG. 6 is an enlarged, partially in cross section, front perspective view of a hand grip in accordance with a second embodiment of the present invention, taken along line 6—6 of FIG. 5.

Referring now to FIGS. 5 and 6, a pair of first handles 24' are positioned at an upper region of each side frame 16 atop an aft portion of the third strut 66. The first handles 24' includes fore and aft generally vertical posts 68, 70 and generally horizontal grips 72' positioned atop the fore and aft posts 68, 70 between fore and aft handle ends 80, 82. As best shown in FIG. 6, the grip or elongate member 72' of the preferred embodiment has an ergonomic profile (described below) and includes a formed cover 84.

As shown in FIG. 6, the elongate member 72' is shown in cross-sectional profile A. cross-sectional profile has a first convex surface 73, a second convex surface 75 adjacent the first convex surface 73, a third convex surface 77 adjacent the second convex surface 75, and a fourth surface 79 between the first and third convex surfaces 73, 77. The first, second, and third convex surfaces 73, 75, 77 preferably have a varying radius of curvature over the length of the elongate member 72' such that a generally elliptical shape is formed in the cross-sectional profile A such that as the cross-sectional profile A is taken at various points along the length of the elongate member 72', the size of the cross-sectional profile A varies to create an elongate member 72' that is larger in its middle than at its ends in both the horizontal and vertical directions.

The grip 24' also includes a retention rib or clip 86 extending outwardly (downwardly as shown in the second preferred embodiment of FIG. 6) from the fourth surface 79, extending at least a portion of the length of the elongate member 72', the rib 86 being generally unshaped in cross section. The rib 86 may be of a cross-sectional shape other than a u-shaped cross section, such as a parabolic curved or round shaped cross section or virtually any other two-dimensional geometric shape.

The elongate member 72' is internally supported along its entire length by an elongate core 88 which preferably is formed as an integral component of each first handle 24' and merges with each first handle 24' at fore and aft handle ends 80, 82. Referring to FIG. 6, the elongate core 88 includes an upper spine portion 90, a neck 94 depending downwardly from the entire length of the bottom of the upper spine portion 90, and a base spine portion 92 depending downwardly from the entire length of the neck 94. In cross-sectional view the upper spine portion 90 is preferably of generally elliptical shape. It is understood by those of ordinary skill in the art that the cross-sectional shape of the upper spine portion may be other than generally an ellipse, such alternate shapes including round, rectangular, oval, square, etc. The upper spine portion includes indentations 96 extending along the entire length its sides. It will be understood by those of ordinary skill in the art that the indentations 96 are for the purpose of decreasing the weight of the walker and are not necessary to the function of the handle. The upper spine portion 90 is preferably broader near its center than near its ends so as to impart an ergonomic shape to the elongate member 72' as will be more fully discussed below. Extending along the length of the neck 94 at the base of each side of the neck 94 are grooves 98. The base spine portion 92 preferably has a cross-sectional shape which is generally trapezoidal.

Figure 7:
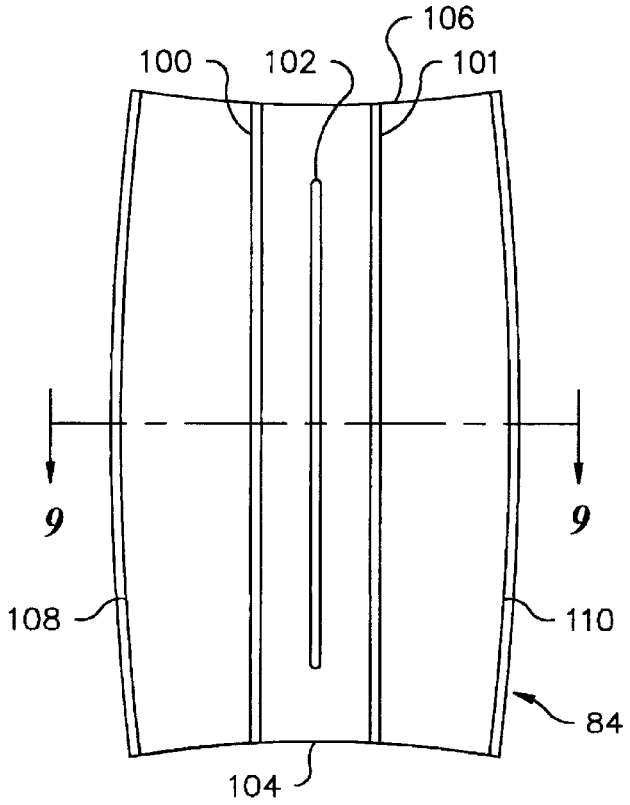
FIG. 7 is a greatly enlarged elevational view of a flat pattern of the interior of a portion of the hand grip of the second embodiment of the present invention.
Figure 8:
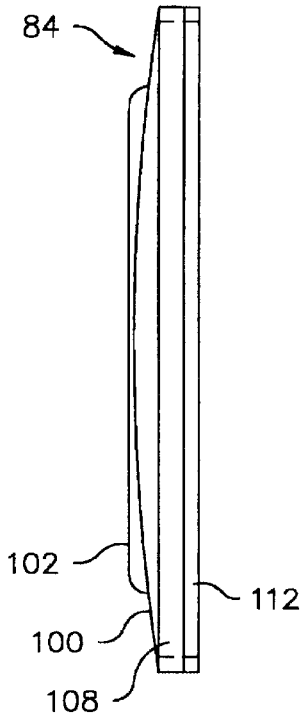
FIG. 8 is a side elevational view of the hand grip as shown in FIG. 7.

Referring to FIG. 7, the formed cover 84 of the preferred embodiment, shown in its unassembled state, has first and second lateral edges 108, 110 and an inner surface 111 extending between the first and second lateral edges 108, 110. The formed cover 84 also has two support ribs 100, 101 on the inner surface 111 which extend the full length of the formed cover 84 and which cause the inner surface 111 to be spaced from the elongate core 88. As best shown in FIG. 8, the first and second support ribs 100, 101 have a curved profile which, when measured from the surface of the formed cover 84, preferably have a maximum height of approximately 0.125 inches in the longitudinal center of the formed cover 84, tapering to 0.0 inches at each end. The formed cover 84 of the preferred embodiment also has a short ridge 102 which is positioned midway between the first and second support ribs 100, 101 and preferably extends only to within approximately one inch of the ends of the formed cover 84. As best shown in FIG. 8, the short ridge 102 has a straight profile and has a maximum height greater than that of the first and second support ribs 100, 101, preferably measuring approximately 0.1875 inches, and having sloping ends.

Figure 9:
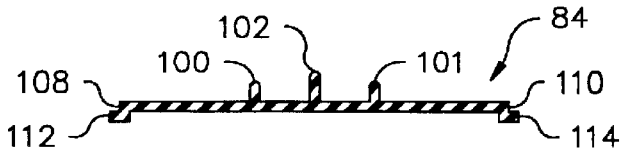
FIG. 9 is a cross-sectional view of the hand grip shown in FIG. 7 taken along line 9—9 of FIG. 7.

The formed cover 84 has curved ends 104, 106 such that when the formed cover 84 is assembled on the elongate core 88, the curved ends 104, 106 will each form a plane which is perpendicular to the longitudinal axis of the elongate member 72'. The curvature of the curved ends 104, 106 takes into account the greater diameter of the elongate core 88 at its center than at its ends such that when the formed cover 84 is assembled on the elongate core 88 the curved sides 108, 110 will become straight for engaging contact with the neck 94 (shown in FIG. 6) along its entire length. Referring to FIG. 9, the first and second lateral edges 108, 110 also have tongues 112, 114 which extend outwardly from the lateral edges 108, 110.

The formed cover 84 of the preferred embodiment is made from a soft, pliable material which has a texture or feel that is comfortable for the user's hands. In the preferred embodiment the formed cover 84 is made from SANTOPRENE, available from Advanced Elastomer Systems L.P., located in Akron, Ohio. Those of ordinary skill in the art will recognize that the formed cover 84 may be made from other elastomeric polymers such as MONOPRENE, without departing from the scope and spirit of the invention.

Referring now to FIG. 6, with the grips 72' in the assembled state, the first and second support ribs 100, 101 and the short ridge 102 (not shown in FIG. 6) support the formed cover 84 on the upper spine portion 90 such that the assembled formed cover 84 will have an ergonomic shape consisting of a convex upward curvature across the width of the upper surface of each elongate member 72' and a convex upward curvature along the length of the upper surface of the elongate member 72' such that the elongate member 72' is broader and higher at its center than at its ends. As stated above, the elongate core 88 is broader at its center than at its ends, thereby imparting a convex outward curvature along the length of each side of the assembled formed cover 84. The first and second support ribs 100, 101 and short ridge 102 also create a gap between the upper spine portion 90 and the inner surface of the formed cover 84, thereby providing a cushioning effect for the hand of the user. The ridges 100, 101, 102 allow the elongate member 72' to be constructed of a more rigid, higher durometer material, which is generally less expensive to manufacture than softer materials because of molding difficulties.

Accordingly, the formed cover 84 of the present invention departs from the cylindrical shape of prior art designs by incorporating an enlarged portion in the center of the hand elongate member 72' to partially emulate the multi-axis, convexly curved surface of a sphere. This feature creates a elongate member 72' to which the hand more naturally conforms. The elliptical cross-sectional profile A of the elongate member 72' functions to increase the loaded surface area in contact with the user's hand, thus reducing unit loading and fatigue of the hand. This is particularly important to the elderly whose hands have less surface tissue and, therefore, cannot tolerate heavy loads for extended periods of time.

As those of ordinary skill in the art will recognize, the use of a combination of support ridges 100, 101, 102 and curvature of the upper spine 90 are only a preferred method of creating an ergonomically-shaped elongate member 72' and alternative structures may be used to create the same or similar ergonomic proportions and shapes. Examples of such structure would be to employ an upper spine portion 90 that has the ergonomic shape incorporated entirely therein and providing a formed cover 84 that conformed to that shape, or to provide an upper spine portion 90 of generally straight proportions along its length and incorporating the ergonomic shape entirely into the formed cover 84. It will also be recognized by those of ordinary skill in the art that more or fewer ridges could be used to support the formed cover 84 or that the measurements and proportions of those ridges could be varied without departing from the scope and spirit of the invention.

Referring now to FIG. 6, the clip 86 includes a resilient outer covering 116 defining the outer surface of the clip 86, and a rib core 118. The clip 86 preferably extends along the entire length of the formed cover 84 and has an external shape which, in cross-section, is generally U-shaped, or, alternatively, that of a parabolic curve or other two-dimensional geometric shape. Extending along the entire length of the clip 86 at the top of each of its sides is a hook 134 that projects inwardly and in operation engages the lateral edges 108, 110 and top surface of the base spine portion 92 adjacent each side of the neck 94 to retain the clip 86 on the elongate member 72' and to securely retain the formed cover 84 on the elongate core 88. Once engaged with the elongate member 72', the clip 86 preferably mates flushly with the bottom surface of the formed cover 84 and provides additional ergonomic features to the elongate member 72', providing the user with a location for positively and comfortably engaging the fingertips.

The outer covering 116 of the preferred embodiment is made from SANTOPRENE, discussed above. However, as those of ordinary skill in the art will recognize, the outer covering 116 can be made from many other elastomeric polymers, such as MONOPRENE. The semi-rigid core 118 is preferably made from polypropylene, however, those of ordinary skill in the art will recognize that other materials such as polyethylene may be used so long as the resilient core 31 provides sufficient resiliency to the clip 86 to enable the clip 86 to remain positively engaged with the base spine portion 92. The clip 86 is preferably constructed by coextrusion whereby the outer covering 116 and resilient core 118 are bonded together in a manner well understood by those of ordinary skill in the art.

The above-described construction of the clip 86 provides an additional advantage to the present invention by providing a lower portion of the elongate member 72' having an outer surface which, like the formed cover 84, has a texture or softness which provides comfort for the user's hand. However, the requirement that the lower portion be made from resilient material such as polypropylene generally precludes the ability to provide such a comfortable outer surface. The hand grip of the second embodiment of the present invention overcomes this problem by employing a coextrusion process for creating a lower portion having an inner core made from highly resilient materials such as polypropylene and an outer covering layer made from softer, comfort-enhancing material. It will be recognized by those of ordinary skill in the art from reading this disclosure that the function of the outer covering 116 is primarily to enhance user comfort and therefore the clip 86 could be constructed without an outer covering 116 without departing from the scope and spirit of the invention.

To assemble the elongate member 72', the formed cover 84 is wrapped around the upper spine portion 90 such that one of the tongues 112, 114 is inset into the groove 98 on one side of the neck 94 and the other tongue 112, 114 is inset into the groove 98 on the other side of the neck 94. The clip 86 is then pressed onto the base spine portion 92 such that the bottom surfaces of the hooks 134 engage the top of the base spine portion 92 adjacent each side of the neck 94. The innermost and top surfaces of the hooks 134 engage the outer surface of the formed cover 84 such that the tongues 112, 114 are held in engagement with the grooves 98, 99, thereby providing an interlocking fit between the clip 86, formed cover 84, and elongate core 88.

In the second embodiment the two-piece design is intended to be coupled to an elongate core 88 supporting the handle and is configured to become an integral part of the clipping feature. However, it is also envisioned that the two-piece design of the present invention could be used as a retrofit on walkers having ordinary handles or spines which are, for example, cylindrical or square in cross-section. In the latter configuration, the elongate core 88 would not be used as a component of the clipping function. The clipping function would be accomplished solely by the formed cover 84 and clip 86. For instance, in an alternative embodiment the elongate core 88 is not an integral component of the clipping function (not shown).

In the second embodiment, the horizontal grip 56 is provided with the same ergonomic structure as the elongate member 72' and includes a second elongate core (not shown) with the same structure as that of the first elongate core 88. The second elongate core (not shown) is preferably unitary with the upper portion of the aft post 54 and the main support 46.

When the walker having the preferred grip is in use, the palm of the user's hand rests on the broad curved surfaces of the formed cover 84 while the fingers comfortably but securely engage the clip 86. Thus, the user's fingers span the tangent from the elliptical portion of the elongate member 72' to the bottom and inside surface of the clip 86. Accordingly, the elongate member 72' of the present invention allows for a greater range of hand sizes to comfortably grasp the entire assembly and provides the user with greater comfort and control compared to prior art cylindrically-based designs.

Figure 10:
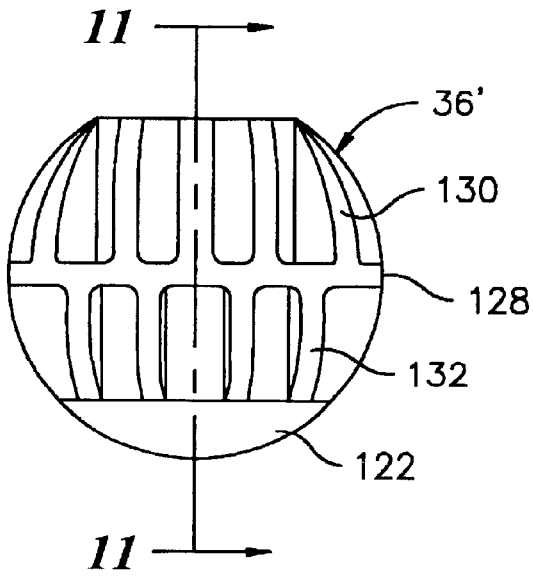
FIG. 10 is a greatly enlarged front elevational view of an end cap in accordance with the second embodiment of the present invention.
Figure 11:
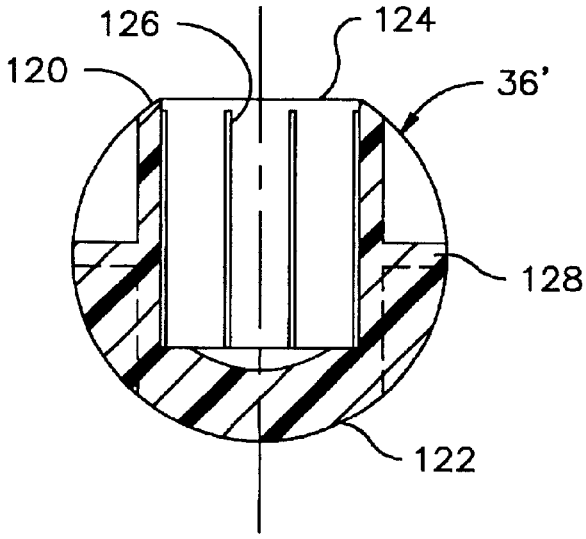
FIG. 11 is a cross-sectional view of the end cap shown in FIG. 10 taken along lines 11—11 of FIG. 10.

Referring now to FIGS. 5, 10 and 11, the walker 10 of the second embodiment has end caps 36' on at least two of the leg portions 28, 30, preferably at least the aft leg portions 30, 22. The end caps 36' have an outer profile which is at least semi-spherically shaped, i.e., spherically shaped in at least a generally downwardly or forwardly facing direction. Each end cap 36' includes at its center a vertical cylindrical core 120 having a bottom 122 defining the spherical shape of the bottom of the end cap 36'. The cylindrical core 120 includes an internal socket 124 having an interference fit with the lower leg portions 30 and having vertical ribs 126 sized to provide a friction fit with the lower leg portions 30. A circumferential ridge 128 extends outwardly from the cylindrical core 120 to define the spherical equator of the end cap 36'. Referring to FIG. 10, extending upwardly from the circumferential ridge 128 and outwardly from the cylindrical core 120 are a series of spaced apart vertical upper ridges 130 that extend about the entire circumference of the cylindrical core 120. Extending downwardly from the circumferential ridge 128 and outwardly from the cylindrical core 120 are a series of spaced apart lower ridges 132 that extend about the entire circumference of the cylindrical core 120. The lower ridges 132 terminate on their lower end at the outer edge of the bottom 122 such that a contiguous spherical shape is maintained across the bottom 122 of the end cap 36'.

In the second embodiment, the end cap 36' is preferably made from a hard, wear resistant material which is easily molded and not affected by hostile elements such as might be encountered in the outdoor environment. The end cap 36' is preferably made from COMALLOY, available from Comalloy International Co., located in Nashville, Tennessee. Those of ordinary skill in the art will recognize that the end cap 36' need not be made from COMALLOY, but may be made from other materials, such as nylon and urethane, without departing from the scope and spirit of the invention. The upper and lower ridges 130, 132 are formed with sufficient thickness to minimize damage from impact and are spaced to require a minimum number of ridges to impart a spherical shape yet resulting in an end cap 36' that is of minimal weight. In the preferred embodiment there are twelve upper ridges 130 and twelve lower ridges 132, evenly distributed around the horizontal circumference of the end cap 36'. Those of ordinary skill in the art, however, will recognize that fewer or more than twelve upper and lower ridges 130, 132 may be used or that the lower and upper ridges could be omitted, without departing from the scope and spirit of the invention.

As shown in FIG. 5, in the second embodiment, the end cap 36' is used only on the aft lower leg portions 30. On the base of the fore lower leg portions 28 are wheels 37' such as those well known to those of ordinary skill in the art. One skilled in the art will appreciate that the end cap 36' described hereinabove is a preferred embodiment and wheels or other devices (not shown) may replace some or all of the end caps 36' described without departing from the spirit and scope of the present invention. Alternatively, the end caps 36' of the preferred embodiment could be used on all four of the lower leg portions 28, 30 (not shown).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

I claim:

1. A hand grip comprising:

an elongate member having a length, a first cross-sectional profile perpendicular to the length, the first cross sectional profile having a first convex surface, a second convex surface adjacent the first convex surface, a third convex surface adjacent the second convex surface, and a fourth surface between the first and third convex surfaces, the first, second, and third convex surfaces having a varying radius of curvature over the length of the elongate member, the elongate member including an elongate core and a formed cover surrounding the elongate core, the formed cover including a first lateral edge and an opposing second lateral edge;

a second cross-sectional profile parallel to the length of the elongate member and perpendicular to the first cross-sectional profile, the second cross-sectional profile having first and second opposed convex surfaces along at least substantially the entire length; and a rib extending outwardly from the fourth surface and extending at least a portion of the length of the elongate member, the rib being generally u-shaped in cross section, the rib engaging the first and second lateral edges.

2. The hand grip of claim 1, wherein the rib engages the elongated core.

3. A hand grip comprising:

an elongate member having a length, a first cross-sectional profile perpendicular to the length, the first cross sectional profile having a first convex surface, a second convex surface adjacent the first convex surface, a third convex surface adjacent the second convex surface, and a fourth surface between the first and third convex surfaces, the first, second, and third convex surfaces having a varying radius of curvature over the length of the elongate member, the elongate member including an elongate core and a formed cover surrounding the elongate core, the formed cover having a thickness which is substantially constant;

a second cross-sectional profile parallel to the length of the elongate member and perpendicular to the first cross-sectional profile, the second cross-sectional profile having first and second opposed convex surfaces along at least substantially the entire length; and a rib extending outwardly from the fourth surface and extending at least a portion of the length of the elongate member, the rib being generally u-shaped in cross section and including a rib core covered by a resilient outer covering.

* * * * *